US012326321B2

(12) United States Patent
Jiang et al.

(10) Patent No.: US 12,326,321 B2
(45) Date of Patent: Jun. 10, 2025

(54) GLOVE ADAPTED TO DISPENSE PULSED ELECTRIC CURRENT TO A HUMAN'S SKIN

(71) Applicant: Far East-West Trading Company LLC, Nicholasville, KY (US)

(72) Inventors: Zhiyong Jiang, Shenzhen (CN); Jeff Niklaus, Nicholasville, KY (US)

(73) Assignee: FAR EAST-WEST TRADING COMPANY, LLC, Nicholasville, KY (US)

( * ) Notice: Subject to any disclaimer, the term of this patent is extended or adjusted under 35 U.S.C. 154(b) by 834 days.

(21) Appl. No.: 17/565,961

(22) Filed: Dec. 30, 2021

(65) Prior Publication Data

US 2022/0120536 A1 Apr. 21, 2022

Related U.S. Application Data

(63) Continuation-in-part of application No. 16/475,099, filed as application No. PCT/CN2017/095097 on Jul. 31, 2017, now abandoned.

(51) Int. Cl.
*F41H 13/00* (2006.01)
*A41D 19/00* (2006.01)

(52) U.S. Cl.
CPC ..... *F41H 13/0018* (2013.01); *A41D 19/0024* (2013.01)

(58) Field of Classification Search
CPC ..... F41H 13/0018; F41H 13/0093; A41D 19/0024; A41D 1/04; A41D 1/002; A41D 20/00; A41D 2600/00; A41D 2400/00
USPC ..... 361/232
See application file for complete search history.

(56) References Cited

U.S. PATENT DOCUMENTS

| | | | | |
|---|---|---|---|---|
| 4,943,885 | A * | 7/1990 | Willoughby | F41H 13/0018 361/232 |
| 5,193,048 | A | 3/1993 | Kaufman et al. | |
| 7,012,797 | B1 * | 3/2006 | Delida | F41H 13/0018 361/232 |
| 9,404,698 | B2 | 8/2016 | Stewart et al. | |
| 2003/0137795 | A1 * | 7/2003 | Buening | H05C 1/06 361/253 |
| 2005/0115387 | A1 * | 6/2005 | Smith | H05C 1/06 89/1.11 |
| 2014/0290109 | A1 | 10/2014 | Stewart et al. | |
| 2019/0216146 | A1 * | 7/2019 | Yang | D05C 1/06 |
| 2020/0355454 | A1 * | 11/2020 | Deng | H04N 5/23203 |

FOREIGN PATENT DOCUMENTS

| | | | |
|---|---|---|---|
| CN | 2358706 | Y | 1/2000 |
| CN | 102778173 | A * | 11/2012 |
| CN | 102778173 | | 11/2014 |
| CN | 105146813 | | 12/2015 |

OTHER PUBLICATIONS

Machine translation of Jiang et al. Chinese Patent Document CN 102778173 A Nov. 2012 (Year: 2012).*

* cited by examiner

*Primary Examiner* — Kevin J Comber
(74) *Attorney, Agent, or Firm* — BUSINESS PATENT LAW, PLLC

(57) ABSTRACT

A glove adapted to dispense pulsed electric current to a human's skin. Pulsed electric current dispensed by the glove can interfere temporarily with muscular locomotion of the human or take down an arrestee, prisoner or suspect.

19 Claims, 3 Drawing Sheets

GLOVE ADAPTED TO DISPENSE PULSED ELECTRIC CURRENT TO A HUMAN'S SKIN

PRIORITY

Applicant claims priority to U.S. application Ser. No. 16/475,099—Catching Glove Management System and Supervision Method—filing date Jun. 30, 2019, Jiang, Z, that claimed priority to PCT Chinese Application PCT/CN2017/095097—Catching Glove Management System and Supervision Method—filed on Jul. 31, 2017. U.S. application Ser. No. 16/475,099—Catching Glove Management System and Supervision Method—and PCT Chinese Application PCT/CN2017/095097—Catching Glove Management System and Supervision Method—are incorporated in their respective entireties into this Nonprovisional Application.

BACKGROUND OF THE INVENTION

A. Field of the Invention

The present invention is glove adapted to dispense pulsed electric current to a human's skin. Among other things, the dispensed pulsed electric current can induce neuro-peripheral interference that temporarily interferes with muscular locomotion of the human.

B. Description of the Previous Art

Any discussion of references cited in this Description of the Previous Art merely summarizes the disclosures of the cited references and Applicant makes no admission that any cited reference or portion thereof is relevant prior art. Applicant reserves the right to challenge the accuracy, relevancy and veracity of the cited references.

Arrest of a criminal suspect is accomplished by law enforcement. Many of the currently available tools used by law enforcement to control a suspect or arrestee can also be used against law enforcement when the suspect or arrested gains control of the tool.

In Chinese utility model Patent No. CN 2358706 Y, a police anti-violence electric shock glove is disclosed. Among other things, the '706 glove utilizes a high-voltage (thousands of volts) electric shock that can burn human skin. Current load associated with such high voltage can damage the heart and central nervous system as well as induce ventricular fibrillation and cardiac arrest.

Chinese Publication No. CN 102778173A discloses a police arrest glove including an insulating sleeve, a first contact electrode, a second contact electrode and an induction low-voltage pulse generator. The glove includes first and second contact electrodes positioned on the palm side of the glove. A first output of the induction low-voltage pulse generator is connected to the first contact electrode and a second output of the induction low-voltage pulse generator is connected to the second contact electrode. When the first contact electrode and the second contact electrode are connected, the induction low-voltage pulse generator outputs a current via the first output electrode and the second output electrode.

Chinese Publication No. CN 105146813A discloses an intelligent arrest glove. The intelligent arrest glove includes a glove body (1), palm electric shock pulse conductors (2), finger electric shock pulse conductors (3), suspension rings (4), a connection buckle (5), an adhesive tape (6), a switch (7), a battery (8), a back striking shell (9) and finger striking shells (10) and a thumb striking piece (11). Two suspension rings (4) are connected on top ends of finger sleeves. The connection buckle (5) is connected at one side of a bottom end of the glove body (1) and adhesive tape (6) is connected at the other side of the bottom end of the glove body (1). A module is connected with the palm electric shock pulse conductors and the finger electric shock pulse conductors via a circuit. Palm electric shock pulse conductors (2) are fixed on the palm of the glove body (1) by leather gaskets. Finger electric shock pulse conductors (3) are fixed at root places of four fingers by leather gaskets. The thumb striking piece (11) is fixed on a back side of a thumb of the glove. Back striking shell (9) is fixed in a middle of a back side of the glove body (1) and back striking shell (9) is of a shape in which four finger joints are raised. The finger striking shells (10) are fixed on an upper end of the back side of the glove body (1). Each of the finger striking shells (10) is of a peach raised shape. Switch (7) is fixed at one side of a lower edge of the back striking shell (9) and is connected with the battery (8) via the power wire. The module is connected to the power wire, the palm electric shock pulse conductors (2) and the finger electric shock pulse conductors (3) via a circuit.

Other references that may indicate a state-of-the-art for the current invention include: 1) U.S. Pat. No. 5,193,048—Kaufman, et al., 2) U.S. Pat. No. 7,012,797B1—Delida, 3) U.S. Pat. No. 9,404,698B2—Stewart, et al. and 4) US20140290109A1—Stewart, et al.

Among other things, none of the above listed references disclose inducement of a neuro-peripheral interference.

SUMMARY OF THE INVENTION

Prior to the present invention, it is believed there was no electrified glove allowing law enforcement to minimize potential injury to an agitated arrestee, prisoner or suspect when circumstances required the "taking down" or temporary distraction of the agitated arrestee, prisoner or suspect. Dispensed pulsed electric current from the present glove flows through the skin's epidermis and dermis and induces a neuro-peripheral interference in the section of the epidermis and dermis receiving the pulsed electric current.

An aspect of the present invention is to provide an electrified glove adapted to take down an arrestee, prisoner or suspect where the electricity applied to the skin is selected from the following ranges of from about to about: 210-380 volts, 0.5-1.5 amperes, charge levels of 84-125 microcoulombs, pulse durations between 105-115 microseconds and pulsed electric current at the rate of about 30 pulses per second.

Still another aspect of the present invention is to provide a glove supplying an electric shock only to the arrestee, prisoner or suspect and not another human in contact with the arrestee, prisoner or suspect.

A preferred embodiment of the current invention can be described as a glove adapted to dispense pulsed electric current to a human's skin, wherein the dispensed pulsed electric current interferes temporarily with muscular locomotion of the human; the glove comprising: a) an inner cavity configured to receive a hand of a user, an outward layer and an insulator; b) the outward layer comprising a plurality of electrodes positioned on the palm side of the glove; the electrodes configured to cause the pulsed electric current to travel, without an electric arc via the skin's epidermis and dermis, between at least two of the plurality of electrodes, and wherein the pulsed electric current fails to penetrate a layer of clothing; c) a voltage source connected to the glove; d) an activation switch attached to the outward layer; and e) a controller connected to the voltage source and the activation/deactivation switch; the controller comprising: i) a microprocessor; ii) a memory; iii) a pulsed output electric current circuit adapted to carry pulsed electric current to one or more of the plurality of electrodes; and iv) a combination of a pulse oscillation circuit and a first booster circuit; the combination connected with the pulsed output electric current circuit such that when the microprocessor activates the combination, the pulsed output electric current circuit delivers pulsed electric current to one or more of the plurality of electrodes, wherein at the point of electrode contact with the skin, the delivered pulsed output electric current traveling through the epidermis and dermis generated by the combination includes the following ranges of from about: 210-380 volts, 0.5-1.5 amperes, charge levels of 84-125 microcoulombs and pulse durations between 105-115 microseconds.

Another preferred embodiment of the current invention can be described as a glove adapted to dispense pulsed electric current to a human's skin, wherein the dispensed pulsed electric current interferes temporarily with muscular locomotion of the human; the glove comprising: a) an inner cavity configured to receive a hand of a user, an outward layer and an insulator; b) the outward layer comprising a plurality of electrodes positioned on the palm side of the glove; the electrodes configured to cause the pulsed electric current to travel, without an electric arc via the skin's epidermis and dermis, between at least two of the plurality of electrodes; c) a voltage source connected to the glove; d) an activation switch attached to the outward layer; and e) a controller connected to the voltage source and the activation/deactivation switch; the controller comprising: i) a microprocessor; ii) a memory; iii) a pulsed output electric current circuit adapted to carry pulsed electric current to one or more of the plurality of electrodes; and iv) a combination of a pulse oscillation circuit and a first booster circuit; the combination connected with the pulsed output electric current circuit such that when the microprocessor activates the combination, the pulsed output electric current circuit delivers pulsed electric current to one or more of the plurality of electrodes, wherein at the point of electrode contact with the skin, the delivered pulsed output electric current traveling through the epidermis and dermis generated by the combination includes the following ranges of from about: 210-380 volts, 0.5-1.5 amperes, charge levels of 84-125 microcoulombs and pulse durations between 105-115 microseconds.

Still another preferred embodiment of the current invention can be described as a glove adapted to dispense pulsed electric current to a human's skin, wherein the dispensed pulsed electric current interferes temporarily with muscular locomotion of the human; the glove comprising: a) an inner cavity configured to receive a hand of a user and an outward layer including an insulator; b) the outward layer comprising a plurality of electrodes positioned on the palm side of the glove; the electrodes configured to cause the pulsed electric current to travel, without an electric arc via the skin's epidermis and dermis, between at least two of the plurality of electrodes; c) a voltage source connected to the glove; d) an activation switch attached to the outward layer; e) a pulsed output electric current circuit adapted to carry pulsed electric current to one or more of the plurality of electrodes; and f) a combination of a pulse oscillation circuit and a booster circuit; the combination connected with the pulsed output electric current circuit such that when the combination is activated, the pulsed output electric current circuit delivers pulsed electric current to one or more of the plurality of electrodes, wherein at the point of electrode contact with the skin, the delivered pulsed output electric current traveling through the epidermis and dermis generated by the combination induces neuro-peripheral interference by stimulating a portion of the peripheral nervous system contained in the skin's epidermis and dermis proximate the electrodes.

It is the novel and unique interaction of these simple elements which creates the apparatus and methods, within the ambit of the present invention. Pursuant to Title 35 of the United States Code, descriptions of preferred embodiments follow. However, it is to be understood that the best mode descriptions do not limit the scope of the present invention.

DESCRIPTION OF THE PREFERRED EMBODIMENTS

Although the disclosure hereof is detailed to enable those skilled in the art to practice the invention, the embodiments published herein merely exemplify the present invention.

The present invention is a glove adapted to dispense pulsed electric current to a human's skin. Applicant believes that the present glove is particularly useful for law enforcement entities and agencies. Meeting a long felt but unfilled need, among other things, the present glove allows law enforcement to minimize potential injury to an agitated arrestee, prisoner or suspect when circumstances require the "taking down" or temporary distraction of the agitated arrestee, prisoner or suspect.

It has been discovered that the present invention's dispensed pulsed electric current flowing through the skin's epidermis and dermis induces a neuro-peripheral interference in the section of the epidermis and dermis receiving the pulsed electric current. When used as instructed by the Applicant, it is believed that the pulsed electric current does not engage tissue beneath the dermis. After the central nervous system detects the neuro-peripheral interference, the neurological signals from the central nervous system and the peripheral nervous system interfere temporarily with muscular locomotion which distracts the agitated arrestee, prisoner or suspect.

Figure 1:
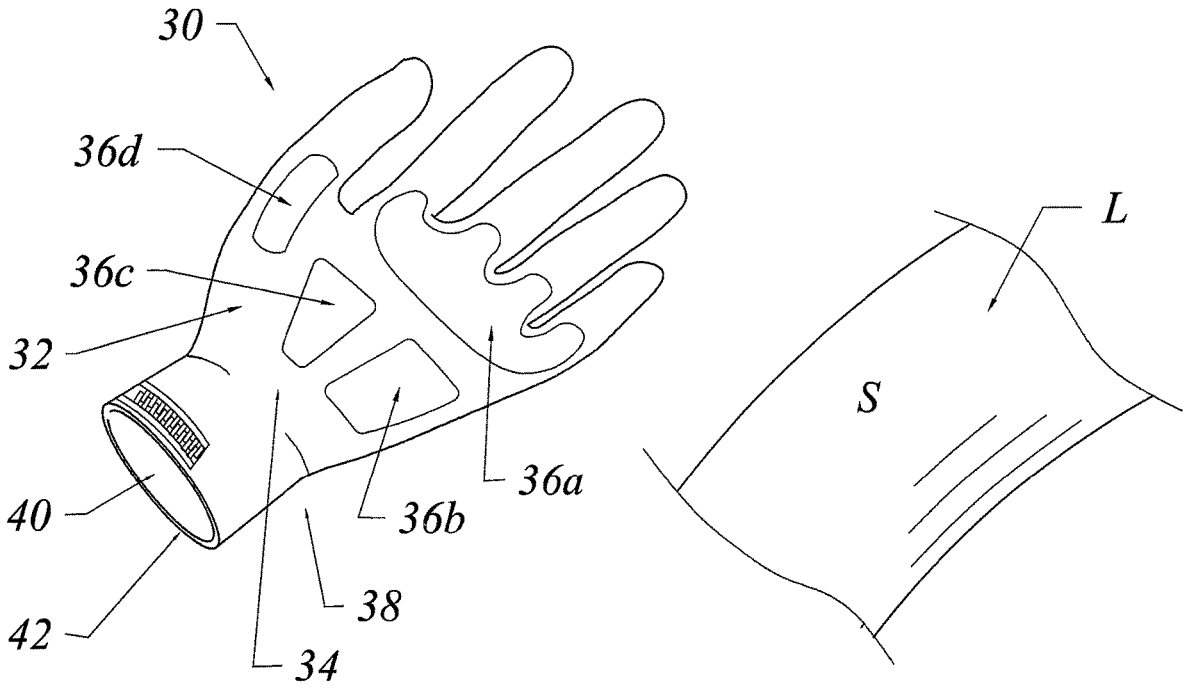
FIG. 1 is a perspective of a preferred embodiment of the palm side (34) of glove (30) and skin (S) of a human limb (L).

As shown in FIG. 1, skin (S) is portrayed as a portion of a human limb (L). Glove (30) is adapted to dispense pulsed electric current to a human's skin (S). Outward layer (32) of glove (30) supports a plurality of electrodes (36*a*, 36*b*, 36*c*, 36*d*, etc.). The plurality of electrodes includes at least one cathode and one anode and the glove is functional with a single anode and cathode. Within the ambit of the present invention, electrodes (36*a*, 36*b*, 36*c*, 36*d*) can be positioned on palm side (34), backside (38) or at any other desired section of glove (30). A preferred location for electrodes (36*a*, 36*b*, 36*c*, 36*d*) is palm side (34) of glove (30). Electrodes (36*a*, 36*b*, 36*c*, 36*d*) are configured to cause the pulsed electric current to travel, without an electric arc via the skin's epidermis and dermis, between at least two of the plurality of electrodes.

It has been discovered that the present invention's dispensed pulsed electric current is effective in the taking down or temporary distraction of the arrestee, prisoner or suspect when administered to the skin (S) of the arrestee, prisoner or suspect. Within the scope of the present invention, the dispensed pulsed electric current will not penetrate clothing, hair or metal. It was also discovered that the dispensed pulsed electric current administered to skin (S) of the agitated arrestee, prisoner or suspect has no effect on another human contacting the agitated arrestee, prisoner or suspect when the dispensed pulsed electric current is administered.

Glove (30) includes inner cavity (40) for receiving a user's hand. In preferred embodiments of the present invention, outward layer (32) can be an insulator between the plurality of electrodes (36*a*, 36*b*, 36*c*, 36*d*) and the user's hand. Other preferred embodiments can include a distinct insulation layer (42) between the plurality of electrodes (36*a*, 36*b*, 36*c*, 36*d*) and the user's hand. Within the scope of the present invention, insulation layer (42) can include a flexible insulator incorporated into a fabric or any other flexible insulator acceptable in the art. A flexible insulator incorporated into a fabric is preferred because the fabric can reduce dampness inside glove (30).

Figure 2:
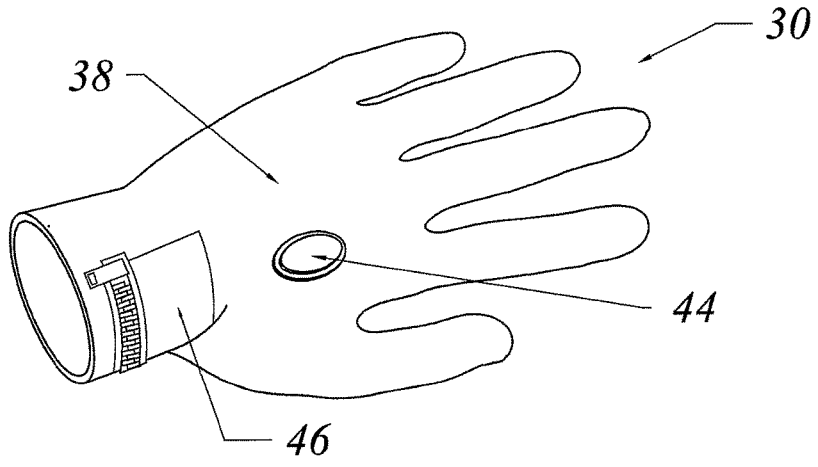
FIG. 2 is a perspective of a preferred embodiment the backside (38) of glove (30).

FIG. 2 portrays the backside (38) of glove (30). Backside (38) of glove (30) includes an attached activation/deactivation switch (44). Backside (38) can also be provided with compartment (46) adapted to contain controller (60) and voltage source (50). Depressing switch (44) actives microprocessor (62) and depressing switch (44) for approximately three seconds deactivates microprocessor (62). Glove (30) can be engineered with any activation/deactivation switch acceptable in the art. Within the ambit of the current invention, the voltage source (50) can be a lithium ion battery or other direct current storage device acceptable in the art. Voltage source (50) can be rechargeable.

Among other things, controller (60) can be provided with a microprocessor (62), memory (64) and pulsed output electric current circuit (66) connected with one or more of the plurality of electrodes (36*a*, 36*b*, 36*c*, 36*d*). Pulsed output electric current circuit (66) is adapted to carry pulsed electric current to one or more of the plurality of electrodes (36*a*, 36*b*, 36*c*, 36*d*). Pulsed output electric current is generated by a combination (68, 72) of pulse oscillation circuit (68) connected with first booster circuit (72). The combination (68, 72) is connected with the pulsed output electric current circuit (66) and microprocessor (62) directs generated pulsed output electric current to pulsed output electric current circuit (66) for transmission to one or more of the plurality of electrodes (36*a*, 36*b*, 36*c*, 36*d*).

Within the scope of the present invention, at the point of contact with one or more electrodes (36*a*, 36*b*, 36*c*, 36*d*) with skin (S), it has been discovered that the delivered pulsed output electric current traveling through the epidermis and dermis of skin (S) generated by the combination includes the following ranges of from about: 210-380 volts, 0.5-1.5 amperes, charge levels of 84-125 microcoulombs and pulse durations between 105-115 microseconds. It has been discovered pulsed output electric current circuit (66) delivers pulsed electric current at the rate of about 29 to about 31 pulses per second. When activated, glove (30) has a duty cycle of from about 32 to about 35 percent.

Figure 3:
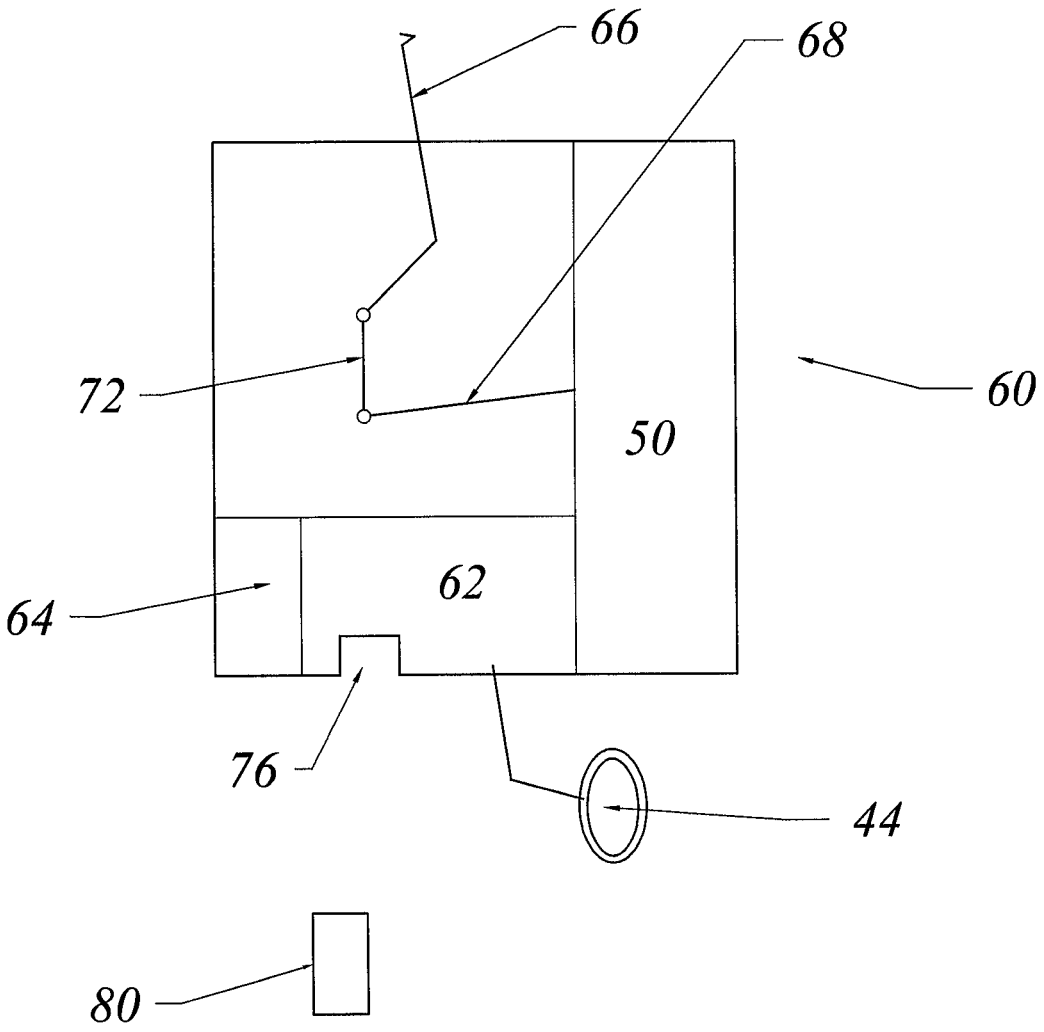
FIG. 3 is a diagram of a preferred embodiment of controller (60) and information device (80) distinct from glove (30).

FIG. 3 is a diagram of a preferred embodiment of controller (60) and information device (80) distinct from glove (30). Glove (30) includes all necessary circuitry for interaction and operation of and communication between its electrical parts.

Controller (60) includes microprocessor (62), memory (64), a portion of pulsed output electric current circuit (66), pulse oscillation circuit (68), first booster circuit (72), voltage source (50) and junction (76) for interconnection with information device (80).

Among other things, each incident of activation or deactivation of glove (30) is stored in memory (64). Along with glove's (30) operational apps, memory (64) is adapted to store the following information such as serial number of the microprocessor, the year, the month and the day of activation or deactivation of glove (30). Within the scope of glove (30), information device (80) can be joined with junction (76) to deliver information that set the microprocessor's initial clock setting to the appropriate time zone.

Alterations in the electrical circuitry or glove (30) can achieve identical results. For example, the combination (68, 72) of pulse oscillation circuit (68) and first booster circuit (72) can connect either first booster circuit (72) or pulse oscillation (68) to voltage source (50). Select preferred embodiments of glove (30) can also include a second booster circuit (not shown in the Drawings).

Within the scope of the present invention, aramid fibers can be incorporated into one or more sections of outward layer (32) of glove (30).

Figure 4:
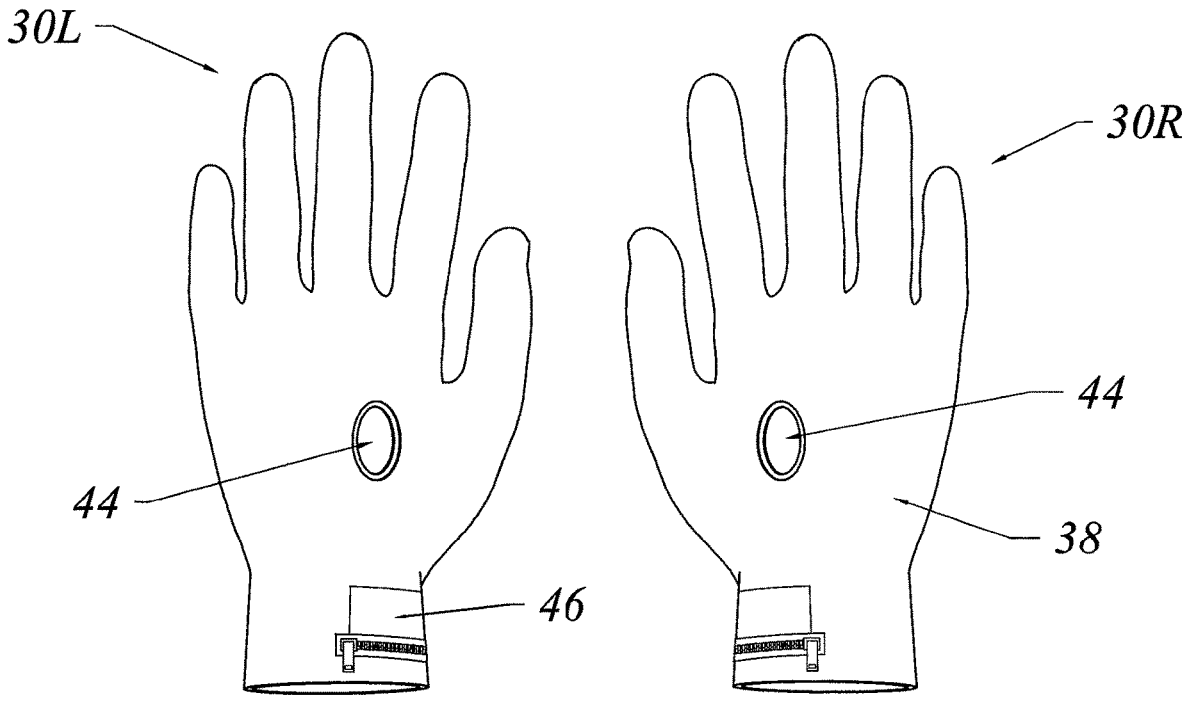
FIG. 4 is perspective of left handed and right handed gloves.

FIG. 4 portrays a pair of right and left handed gloves (30L, 30R). Within the scope of the present invention, when distracting the agitated arrestee, prisoner or suspect, one or a pair of gloves can be utilized. The components of gloves (30L, 30R) are identical to glove (30).

Applicant has enabled, described and disclosed the invention as required by Title 35 of the United States Code and/or the Articles of the Patent Cooperation Treaty.

What is claimed is:

1. A glove adapted to dispense pulsed electric current to a human's skin, wherein the dispensed pulsed electric current interferes temporarily with muscular locomotion of the human; the glove comprising:

a) an inner cavity configured to receive a hand of a user, an outward layer and an insulator;

b) the outward layer comprising a plurality of electrodes positioned on the palm side of the glove; the electrodes configured to cause the pulsed electric current to travel, without an electric arc via the skin's epidermis and dermis, between at least two of the plurality of electrodes, and wherein the pulsed electric current fails to penetrate clothing, hair or metal;

c) a voltage source connected to the glove;

d) an activation switch attached to the outward layer; and e) a controller connected to the voltage source and the activation/deactivation switch; the controller comprising:

i) a microprocessor;

ii) a memory;

iii) a pulsed output electric current circuit adapted to carry pulsed electric current to one or more of the plurality of electrodes; and iv) a combination of a pulse oscillation circuit and a first booster circuit; the combination connected with the pulsed output electric current circuit such that when the microprocessor activates the combination, the pulsed output electric current circuit delivers pulsed electric current to one or more of the plurality of electrodes, wherein at the point of electrode contact with the skin, the delivered pulsed output electric current traveling through the epidermis and dermis generated by the combination includes the following ranges of from about: 210-380 volts, 0.5-1.5 amperes, charge levels of 84-125 microcoulombs and pulse durations between 105-115 microseconds.

2. The glove of claim 1, wherein the pulsed output electric current circuit delivers pulsed electric current at the rate of about 29 to about 31 pulses per second and comprises a duty cycle of from about 32 to about 35 percent.

3. The glove of claim 2, wherein the pulsed electric current induces neuro-peripheral interference by stimulating a portion of the peripheral nervous system contained in the skin's epidermis and dermis proximate the electrodes.

4. The glove of claim 3 comprising an information device, distinct from the glove and connectable to the microprocessor, adapted to supply programming information to the memory.

5. The glove of claim 4 comprising a compartment connected with the outward layer; the compartment adapted to contain the voltage source and the microprocessor, wherein the voltage source is rechargeable.

6. A glove adapted to dispense pulsed electric current to a human's skin, wherein the dispensed pulsed electric current interferes temporarily with muscular locomotion of the human; the glove comprising:

a) an inner cavity configured to receive a hand of a user, an outward layer and an insulator;

b) the outward layer comprising a plurality of electrodes positioned on the palm side of the glove; the electrodes configured to cause the pulsed electric current to travel, without an electric arc via the skin's epidermis and dermis, between at least two of the plurality of electrodes;

c) a voltage source connected to the glove;

d) an activation switch attached to the outward layer; and e) a controller connected to the voltage source and the activation/deactivation switch; the controller comprising:

i) a microprocessor;

ii) a memory;

iii) a pulsed output electric current circuit adapted to carry pulsed electric current to one or more of the plurality of electrodes; and iv) a combination of a pulse oscillation circuit and a first booster circuit; the combination connected with the pulsed output electric current circuit such that when the microprocessor activates the combination, the pulsed output electric current circuit delivers pulsed electric current to one or more of the plurality of electrodes, wherein at the point of electrode contact with the skin, the delivered pulsed output electric current traveling through the epidermis and dermis generated by the combination includes the following ranges of from about: 210-380 volts, 0.5-1.5 amperes, charge levels of 84-125 microcoulombs and pulse durations between 105-115 microseconds.

7. The glove of claim 6, wherein the pulsed output electric current circuit delivers pulsed electric current at the rate of about 29 to about 31 pulses per second.

8. The glove of claim 7, wherein the pulsed electric current induces neuro-peripheral interference by stimulating a portion of the peripheral nervous system contained in the skin's epidermis and dermis proximate the electrodes.

9. The glove of claim 7 comprising an information device, distinct from the glove and connectable to the microprocessor, adapted to supply programming information to the memory.

10. The glove of claim 7 comprising a duty cycle of from about 32 to about 35 percent.

11. The glove of claim 8, wherein the pulsed electric current fails to penetrate a layer of clothing, hair or metal.

12. The glove of claim 11 comprising a compartment connected with the outward layer; the compartment adapted to contain the voltage source and the controller, wherein the voltage source is rechargeable.

13. A glove adapted to dispense pulsed electric current to a human's skin, wherein the dispensed pulsed electric current interferes temporarily with muscular locomotion of the human; the glove comprising:

a) an inner cavity configured to receive a hand of a user and an outward layer including an insulator;

b) the outward layer comprising a plurality of electrodes positioned on the palm side of the glove; the electrodes configured to cause the pulsed electric current to travel, without an electric arc via the skin's epidermis and dermis, between at least two of the plurality of electrodes;

c) a voltage source connected to the glove;

d) an activation switch attached to the outward layer; and e) a pulsed output electric current circuit adapted to carry pulsed electric current to one or more of the plurality of electrodes, wherein at least two of the plurality of electrodes contacting the skin deliver pulsed output electric current, traveling through the epidermis and dermis, induce neuro-peripheral interference by stimulating a portion of the peripheral nervous system contained in the skin's epidermis and dermis proximate the at least two electrodes; the delivered pulsed output electric current administered in the following ranges of from about: 210-380 volts, 0.5-1.5 amperes, charge levels of 84-125 microcoulombs and pulse durations between 105-115.

14. The glove of claim 13, wherein the pulsed output electric current circuit delivers pulsed electric current at the rate of about 29 to about 31 pulses per second.

15. The glove of claim 13 comprising a controller connected to the voltage source and the activation/deactivation switch; the controller comprising: a microprocessor and a memory.

16. The glove of claim 15, wherein the pulsed electric current fails to penetrate a layer of clothing, hair or metal.

17. The glove of claim 16 comprising an information device, distinct from the glove and connectable to the microprocessor, adapted to supply programming information to the memory.

18. The glove of claim 17 comprising a duty cycle of from about 32 to about 35 percent.

19. The glove of claim 18 comprising a compartment connected with the outward layer; the compartment adapted to contain the voltage source and the microprocessor, wherein the voltage source is rechargeable.

* * * * *